US010310401B2

(12) United States Patent
Washino

(10) Patent No.: US 10,310,401 B2
(45) Date of Patent: Jun. 4, 2019

(54) TONER

(71) Applicant: KYOCERA Document Solutions Inc., Osaka (JP)

(72) Inventor: Yusuke Washino, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/101,150

(22) Filed: Aug. 10, 2018

(65) Prior Publication Data

US 2019/0056678 A1 Feb. 21, 2019

(30) Foreign Application Priority Data

Aug. 21, 2017 (JP) ..... 2017-158602

(51) Int. Cl.

| | |
|---|---|
| ***G03G 9/093*** | (2006.01) |
| ***G03G 9/087*** | (2006.01) |
| ***G03G 15/08*** | (2006.01) |
| ***G03G 15/20*** | (2006.01) |

(52) U.S. Cl.

CPC ..... *G03G 9/09364* (2013.01); *G03G 9/087* (2013.01); *G03G 9/0935* (2013.01); *G03G 9/09307* (2013.01); *G03G 9/09321* (2013.01); *G03G 9/09357* (2013.01); *G03G 15/0865* (2013.01); *G03G 15/2028* (2013.01)

(58) Field of Classification Search

CPC ..... G03G 9/09321; G03G 9/09357; G03G 9/09364; G03G 9/09328; G03G 9/09314; G03G 9/09307; G03G 9/0935; G03G 9/093

USPC ..... 430/110.2

See application file for complete search history.

(56) References Cited

U.S. PATENT DOCUMENTS 4,540,644 A * 9/1985 Jacob ..... G03G 9/0926 427/195

6,165,667 A 12/2000 Takagi et al.

FOREIGN PATENT DOCUMENTS

JP 2000-131875 A 5/2000

OTHER PUBLICATIONS

Grant, R. & al, ed., Grant & Hackh's Chemical Dictionary,fifth edition, McGraw-Hill Book Company, NY (1987), p. 257. (Year: 1987).*

* cited by examiner

*Primary Examiner* — Janis L Dote

(74) *Attorney, Agent, or Firm* — Studebaker & Brackett PC

(57) ABSTRACT

A toner includes a plurality of toner particles each including a core and a shell layer entirely covering a surface of the core. The core contains a foamable polymer having a foamable group that is foamable through heating. A first foaming amount is at least 7 mL. The first foaming amount is an amount of gas collected over water during a period from when heating of the toner up to 120° C. is started at 30° C. to when a temperature of the toner has been kept at 120° C. for 30 minutes after the heating. A second foaming amount is at least 6 mL. The second foaming amount is an amount of gas collected over water during a period from when the heating is started at 30° C. to when the temperature of the toner reaches 0° C. through cooling after the liquid has been kept at 120° C. for 30 minutes.

7 Claims, No Drawings

TONER

INCORPORATION BY REFERENCE

The present application claims priority under 35 U.S.C. § 119 to Japanese Patent Application No. 2017-158602, filed on Aug. 21, 2017. The contents of this application are incorporated herein by reference in their entirety.

BACKGROUND

The present disclosure relates to a toner, and more particularly to a capsule toner.

An example of a known toner contains a foaming agent. The toner contains a low-boiling substance as the foaming agent. The toner foams through evaporation (vaporization) of the low-boiling substance therein.

SUMMARY

A toner according to an aspect of the present disclosure includes a plurality of toner particles each including a core and a shell layer covering a surface of the core. The core contains a foamable polymer having a foamable group that is foamable through heating. The shell layer entirely covers the surface of the core.

DETAILED DESCRIPTION

The following describes an embodiment of the present disclosure in detail. Unless otherwise stated, evaluation results (for example, values indicating shape and physical properties) for particles (specific examples include toner cores, toner mother particles, an external additive, and a toner) are number averages of values measured for a suitable number of particles among the particles of interest.

A number average particle diameter of particles is a number average of equivalent circle diameters of primary particles (Heywood diameter: diameters of circles having the same areas as projected areas of the particles) measured using a microscope, unless otherwise stated. A value for a volume median diameter ($D_{50}$) of particles is measured based on the Coulter principle (electrical sensing zone technique) using "Coulter Counter Multisizer 3", product of Beckman Coulter, Inc., unless otherwise stated.

A value for a glass transition point (Tg) is measured in accordance with "Japanese Industrial Standard (JIS) K7121-2012" using a differential scanning calorimeter ("DSC-6220", product of Seiko Instruments Inc.), unless otherwise stated. On a heat absorption curve (vertical axis: heat flow (DSC signal), horizontal axis: temperature) plotted using the differential scanning calorimeter, a temperature at a point of inflection (specifically, a temperature at an intersection point between an extrapolation of a base line and an extrapolation of an inclined portion of the curve) caused due to glass transition corresponds to the glass transition point (Tg). A value for a softening point (Tm) is measured using a capillary rheometer ("CFT-500D", product of Shimadzu Corporation), unless otherwise stated. On an S-shaped curve (horizontal axis: temperature, vertical axis: stroke) plotted using the capillary rheometer, the softening point (Tm) is a temperature corresponding to a stroke value of "(base line stroke value+maximum stroke value)/2".

Acid values and hydroxyl values are measured in accordance with "Japanese Industrial Standard (JIS) K0070-1992", unless otherwise stated. Values for a number average molecular weight (Mn) and a mass average molecular weight (Mw) are measured by gel permeation chromatography, unless otherwise stated.

The term a "main component" of a material used herein refers to a component that accounts for the largest proportion of the mass of the material, unless otherwise stated. Chargeability refers to chargeability in triboelectric charging, unless otherwise stated. Strength of positive chargeability (or strength of negative chargeability) in triboelectric charging can be confirmed using for example a known triboelectric series.

Hereinafter, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. The term "(meth) acryl" may be used as a generic term for both acryl and methacryl.

A toner according to the present embodiment is for example a positively chargeable toner that can be favorably used in development of electrostatic latent images. The toner according to the present embodiment includes a plurality of toner particles (particles each having features described below). The toner may be used as a one-component developer. Alternatively, a two-component developer may be prepared by mixing the toner and a carrier using a mixer (specific examples include a ball mill).

The toner particles included in the toner according to the present embodiment each include a core (referred to below as a "toner core") and a shell layer (a capsule layer) disposed over a surface of the toner core. The toner cores contain a binder resin. As necessary, an internal additive (for example, at least one of a releasing agent, a colorant, a charge control agent, and a magnetic powder) may be dispersed in the binder resin of the toner cores. The shell layers are substantially composed of a resin. An additive may be dispersed in the resin composing the shell layers. Surfaces of the shell layers may have an external additive adhering thereto. The external additive may be omitted in a situation in which such an additive is not necessary. The toner mainly includes the toner particles having the shell layers (for example, in an amount of at least 80% by number) but may also include toner particles having no shell layers.

The toner according to the present embodiment can for example be used in image formation in an electrophotographic apparatus (image forming apparatus). The following describes an example of image forming methods that are performed by an electrophotographic apparatus.

First, an image forming section (for example, a charger and a light exposure device) of the electrophotographic apparatus forms an electrostatic latent image on a photosensitive member based on image data. Next, a developing device (specifically, a developing device having a toner-containing developer loaded therein) of the electrophotographic apparatus supplies the toner to the photosensitive member to develop the electrostatic latent image formed on the photosensitive member. The toner is charged by friction with a carrier, a development sleeve, or a blade in the developing device before being supplied to the photosensitive member. For example, a positively chargeable toner is positively charged. In this developing step, the toner (specifically, the charged toner) on the development sleeve (for example, a surface portion of a developing roller in the developing device) disposed in the vicinity of the photosensitive member is supplied to the photosensitive member to adhere to the electrostatic latent image, which is an exposed region of the photosensitive member, and thus a toner image is formed on the photosensitive member. Toner in an amount corresponding to the amount of the toner consumed in the developing step is supplied to the developing device from a toner container containing toner for replenishment use.

Subsequently, in a transfer step, a transfer device of the electrophotographic apparatus transfers the toner image on the photosensitive member onto an intermediate transfer member (for example, a transfer belt), and then further transfers the toner image on the intermediate transfer member onto a recording medium (for example, paper). Thereafter, in a fixing step, a fixing device of the electrophotographic apparatus fixes the toner to the recording medium by applying heat and pressure to the toner (nip fixing through a nip between a heating roller and a pressure roller). As a result, an image is formed on the recording medium. A full-color image can for example be formed by superimposing toner images of four different colors: black, yellow, magenta, and cyan. A direct transfer process may alternatively be employed, in which the toner image is directly transferred to the recording medium without the use of the intermediate transfer member.

The toner according to the present embodiment has the following features (referred to below as "basic features").

(Basic Features of Toner)

The toner includes a plurality of toner particles each including a toner core and a shell layer covering a surface of the toner core. The toner cores contain a foamable polymer having a foamable group that is foamable through heating. Each of the shell layers entirely covers the surface of the corresponding toner core.

In general, heat-resistant preservability of the toner increases and low-temperature fixability of the toner decreases with an increase in coverage ratio of the toner cores by the shell layers. The use of shell layers susceptible to external force or heat increases low-temperature fixability of the toner but reduces heat-resistant preservability of the toner. It is therefore difficult to achieve both heat-resistant preservability and low-temperature fixability of the toner.

Focusing on the fact that a hard shell in a hollow structure, such as an eggshell, is resistant to pressure from the outside of the structure but easily breakable by pressure from the inside of the structure, the present inventor devised the toner having the above-described basic features. The foamable polymer in the toner cores of the toner having the above-described basic features foams through heating. The shell layers can be ruptured upon pressure applied from the toner cores to the shell layers by causing the toner cores entirely covered with the shell layers to foam. In a situation in which the surfaces of the toner cores are not entirely covered with the shell layers, gas is released from uncovered portions of the surfaces of the toner cores, making it difficult to apply sufficient pressure to the shell layers.

The toner cores of the toner having the above-described basic features contain a foamable polymer having a foamable group that is foamable through heating. The foamable group is present at ends of molecules of the foamable polymer. The foamable polymer foams as the foamable group degrades through heating. The inventor has found that the foamable polymer according to the present embodiment tends not to produce ultrafine particles (UFPs), unlike low-molecular weight foaming agents such as p,p'-oxybis benzene sulfonyl hydrazide (OBSH), dinitrosopentamethylenetetramine (DPT), or azodicarbonamide (ADCA). Note that the term UFPs means particles having a diameter of no greater than 0.1 μm. Thus, the foamable polymer according to the present embodiment is environment-friendly. Because of the above-described basic features, it is possible to provide a core-foamable capsule toner that produces fewer UFPs. The foamable polymer according to the present embodiment is environment-friendly also because the foamable polymer tends not to generate carbon monoxide or ammonia. In terms of inhibiting production of UFPs, the foamable polymer preferably has a mass average molecular weight (Mw) of at least 50,000, and particularly preferably at least 100,000. In terms of productivity of the foamable polymer, the foamable polymer preferably has a mass average molecular weight (Mw) of at least 100,000 and no greater than 200,000.

In order to adequately rupture the shell layers in the fixing step, preferably, the foamable polymer sufficiently foams in the fixing step. In order to ensure sufficient low-temperature fixability of the toner, preferably, a first foaming amount upon heating is at least 7 mL, and a second foaming amount upon cooling after the heating is at least 6 mL. The first foaming amount is an amount of gas collected over water during a period from when heating up to 120° C. is started at 30° C. to when a temperature of the liquid has been kept at 120° C. for 30 minutes after the heating. The first foaming amount is measured at a time X according to a foaming amount measurement method described below and determined relative to 100 g of the toner. The second foaming amount is an amount of gas collected over water during a period from when the heating is started at 30° C. to when the temperature of the liquid reaches 0° C. through cooling after the liquid has been kept at 120° C. for 30 minutes. The second foaming amount is measured at a time Y according to the foaming amount measurement method described below and determined relative to 100 g of the toner.

(Foaming Amount Measurement Method)

A liquid at 30° C. containing 100 g of the toner is heated up to 120° C. at a rate of 1° C./minute. Subsequently, the temperature of the liquid is kept at 120° C. for 30 minutes. The time X is when 30 minutes elapses after the temperature of the liquid has reached 120° C. The first foaming amount is measured at the time X. Subsequently, the liquid is cooled to 0° C. The time Y is when the temperature of the liquid reaches 0° C. The second foaming amount is measured at the time Y. Note that gas is collected over water.

The first foaming amount is also referred to below as a "foaming amount $F_1$" or simply as "$F_1$". The second foaming amount is also referred to below as a "foaming amount $F_2$" or simply as "$F_2$".

The gas collected according to the above-described foaming amount measurement method liquefies or solidifies through cooling. Accordingly, the foaming amount $F_2$ is smaller than the foaming amount $F_1$. The present inventor has found that a foaming agent tends to produce UFPs as long as the foaming agent generates gas that easily liquefies or solidifies through cooling. A value ($=F_1-F_2$) calculated by subtracting the second foaming amount from the first foaming amount is preferably no greater than 25% by volume of the first foaming amount ($=F_1$), and particularly preferably no greater than 20% by volume.

Particularly preferably, the foamable group is an azido group ($—N_3$). Upon heating, the azido group degrades through an exothermic reaction such as "$—N_3 \rightarrow —N+N_2$" to generate nitrogen. In terms of improving low-temperature fixability of the toner, preferably, such an exothermic reaction occurs at 120° C. That is, it is preferable that the azido group generates nitrogen through an exothermic reaction when the toner cores are heated at 120° C. This facilitates adequate rupture of the shell layers in the fixing step. Once the exothermic reaction starts, heat is generated to accelerate the reaction. In terms of improving heat-resistant preservability of the toner, preferably, the exothermic reaction does not occur at a temperature of no greater than 60° C.

More specifically, it is particularly preferable that the foamable polymer includes a unit represented by formula (1) shown below. The foamable polymer is easily obtained through polymerization of a vinyl compound having a foamable group (for example, an azido group). A vinyl compound refers to a compound having a vinyl group ($CH_2$═CH—) or a substituted vinyl group in which hydrogen is replaced. Examples of vinyl compounds that can be used include ethylene, propylene, butadiene, vinyl chloride, acrylic acid, acrylic acid esters, methacrylic acid, methacrylic acid esters, acrylonitrile, and styrene. The vinyl compound can be formed into a polymer (macromolecule) by addition polymerization ("C═C"→"—C—C—") through carbon-to-carbon double bonds "C═C".

(1)

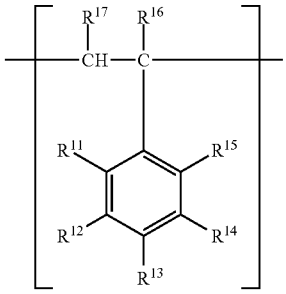

In formula (1), $R^{16}$ and $R^{17}$ each represent, independently of one another, a hydrogen atom, a halogen atom, or an optionally substituted alkyl group. At least one of $R^{11}$, $R^{12}$, $R^{13}$, $R^{14}$, and $R^{15}$ represents an azidomethyl group (—$CH_2$—$N_3$), and the others (chemical groups that are each not an azidomethyl group among $R^{11}$ to $R^{15}$) each represent, independently of one another, a hydrogen atom, a halogen atom, a hydroxyl group, an optionally substituted alkyl group, an optionally substituted alkoxy group, or an optionally substituted aryl group. $R^{11}$ to $R^{15}$ may be all azidomethyl groups. For example, in the case of a repeating unit derived from a product of a reaction of 4-chloromethyl styrene and tetrabutylammonium azide, $R^{16}$ and $R^{17}$ each represent a hydrogen atom, and among $R^{11}$, $R^{12}$, $R^{13}$, $R^{14}$, and $R^{15}$, $R^{13}$ represents an azidomethyl group and the others ($R^{11}$, $R^{12}$, $R^{14}$, and $R^{15}$) each represent a hydrogen atom.

In order to achieve both heat-resistant preservability and low-temperature fixability of the toner, it is particularly preferable that the foamable polymer according to the above-described basic features further includes a unit represented by formula (2) shown below in addition to the unit represented by formula (1). The foamable polymer including the unit represented by formula (1) and the unit represented by formula (2) may be cross-linked. Preferably, a compound having at least two unsaturated bonds is used as a cross-linking agent. Particularly preferably, a di(meth)acrylic acid diester (specific examples include ethylene glycol dimethacrylate and butanediol dimethacrylate) is used as a cross-linking agent.

(2)

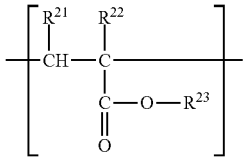

In formula (2), $R^{21}$ and $R^{22}$ each represent, independently of one another, a hydrogen atom or a methyl group. $R^{23}$ represents an optionally substituted alkyl group having a carbon number of at least 1 and no greater than 8. Preferably, $R^{21}$ and $R^{22}$ each represent, independently of one another, a hydrogen atom or a methyl group. Particularly preferably, $R^{21}$ and $R^{22}$ are a combination in which $R^{21}$ represents a hydrogen atom and $R^{22}$ represents a hydrogen atom or a methyl group. Particularly preferably, $R^{23}$ represents an alkyl group having a carbon number of at least 1 and no greater than 4. In the case of a repeating unit derived from butyl acrylate, $R^{21}$ represents a hydrogen atom, $R^{22}$ represents a hydrogen atom, and $R^{23}$ represents a butyl group (that is, an alkyl group having a carbon number of 4).

The foaming amount of the toner cores (specifically, the amount of gas generated by the toner cores in the fixing step) tends to increase with an increase in the proportion of a foamable group-containing unit (for example, the unit represented by formula (1)) out of all the units included in the foamable polymer including the foamable group-containing unit and a foamable group-free unit (for example, the unit represented by formula (2)). In order to adequately rupture the shell layers using the gas generated by the toner cores, the proportion of the foamable group-containing unit out of all the units included in the foamable polymer is preferably at least 0.08% by mass and no greater than 25% by mass.

The toner cores may further contain a non-foamable polymer in addition to the foamable polymer. The foaming amount of the toner cores is readily adjusted through the toner cores containing both the foamable polymer and the non-foamable polymer. Specifically, the foaming amount of the toner cores tends to increase with an increase in the ratio of an amount of the foamable polymer to a sum of the amount of the foamable polymer and an amount of the non-foamable polymer. Particularly preferably, the ratio of the amount of the foamable polymer to the sum of the amount of the foamable polymer and the amount of the non-foamable polymer is at least 0.02 and no greater than 1.00 in order to adequately rupture the shell layers using the gas generated by the toner cores. The ratio of the amount of the foamable polymer to the sum of the amount of the foamable polymer and the amount of the non-foamable polymer being 1.00 means that the toner cores contain no non-foamable polymer. Particularly preferably, the non-foamable polymer is a polyester resin in order to ensure sufficient low-temperature fixability of the toner.

Particularly preferably, the toner cores containing both the foamable polymer and the non-foamable polymer are pulverized cores. In general, toner cores are broadly classified as being pulverized cores (also referred to as a pulverized toner) and as being polymerized cores (also referred to as a chemical toner). Toner cores obtained by a pulverization method are classified as being the pulverized cores and toner cores obtained by an aggregation method are classified as being the polymerized cores. Particularly preferably, the toner cores contain a melt-kneaded product of the foamable polymer, the non-foamable polymer, and an internal additive in order to obtain toner cores that appropriately foam in the fixing step.

In order to adequately rupture the shell layers using the gas generated by the toner cores, preferably, the shell layers are sufficiently hard. Preferably, the shell layers of the toner having the above-described basic features contain a thermosetting resin. Unlike thermoplastic resins, thermosetting resins do not soften through heating. Shell layers containing a thermosetting resin tend to remain hard even when heated in the fixing step and tend to be quickly ruptured by the gas generated by the toner cores. Therefore, the toner is fixed smoothly even in the case of high-speed printing.

Particularly preferably, the thermosetting resin contained in the shell layers is a copolymer of at least two vinyl compounds including at least a compound represented by formula (3) shown below.

(3)

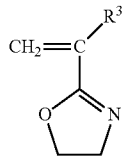

In formula (3), $R^3$ represents a hydrogen atom or an optionally substituted alkyl group (straight-chain, branched, or ring). Particularly preferably, $R^3$ represents a hydrogen atom or a methyl group. For example, in the case of a repeating unit derived from 2-vinyl-2-oxazoline, $R^3$ in formula (3) represents a hydrogen atom.

The compound represented by formula (3) has a non-ring-opened oxazoline group. The non-ring-opened oxazoline group has a ring structure and is highly positively chargeable. The non-ring-opened oxazoline group is reactive with a carboxyl group, an aromatic sulfanyl group, and an aromatic hydroxyl group. As a result of the shell layers containing a thermosetting resin substituted with such an oxazoline group, the shell layers and the toner cores are strongly bound to one another. The oxazoline group reacts with a carboxyl group to readily form an amide ester bond. The surfaces of the toner cores can have a sufficient amount of carboxyl groups through the toner cores containing a polyester resin (preferably, a polyester resin having an acid value of at least 20 mgKOH/g). In the case of toner cores having no reactive group (for example, a carboxyl group) on surfaces thereof, a compound having a reactive group (for example, a carboxyl group) is added so that the toner cores and the shell layers are bound to one another via the compound. Thin shell layers (for example, shell layers having a thickness of at least 0.1 nm and no greater than 3.0 nm) tend to be formed more readily when a copolymer of vinyl compounds is used to form the shell layers than when an aminoaldehyde resin such as a melamine-based resin is used to form the shell layers.

In order to achieve both heat-resistant preservability and low-temperature fixability of the toner, preferably, the toner cores have a glass transition point (Tg) of at least 35° C. and no greater than 45° C.

In order to form high-quality images using the toner, preferably, the toner has a volume median diameter ($D_{50}$) of at least 4 μm and no greater than 9 μm.

The following describes a toner production method. A material for forming the shell layers is referred to below as a "shell material".

Examples of preferable methods for preparing the toner cores include a pulverization method and an aggregation method. These methods facilitate sufficient dispersion of internal additives in the binder resin.

In one example of the pulverization method, the binder resin, the colorant, the charge control agent, and the releasing agent are first mixed together. Subsequently, the resultant mixture is melt-kneaded using a melt-kneader (for example, a single- or twin-screw extruder). Subsequently, the resultant melt-kneaded product is pulverized and classified. Through the above, toner cores having a desired particle diameter are obtained.

In one example of the aggregation method, fine particles of the binder resin, the releasing agent, and the colorant are first caused to aggregate in an aqueous medium containing the aforementioned fine particles until particles of a desired diameter are obtained. Through the above, aggregates containing the binder resin, the releasing agent, and the colorant are formed. Subsequently, the resultant aggregates are heated to cause components of the aggregates to coalesce. Through the above, toner cores having a desired particle diameter are obtained.

Examples of methods for forming the shell layers include in-situ polymerization, in-liquid curing film coating, and coacervation. More specifically, according to a preferable method for forming the shell layers on the surfaces of the toner cores (a first shell layer formation method), the toner cores are added into an aqueous medium containing a water-soluble shell material dissolved therein, and thereafter the aqueous medium is heated to promote a polymerization reaction of the shell material.

Alternatively, resin particles (for example, a resin dispersion) may be used as a shell material in the formation of the shell layers. More specifically, according to another preferable method for forming the shell layers on the surfaces of the toner cores (a second shell layer formation method), the resin particles are caused to adhere the surfaces of the toner cores in a liquid (for example, an aqueous medium) containing the resin particles and the toner cores, and thereafter the liquid is heated to promote formation of films of the resin particles. Bonding between the resin particles (consequently, a cross-linking reaction in the resin particles) can be promoted on the surfaces of the toner cores while the liquid is kept at a high temperature.

The aqueous medium is a medium containing water as a main component (specific examples include pure water and a liquid mixture of water and a polar medium). Examples of the polar medium that can be used in the aqueous medium include alcohols (specific examples include methanol and ethanol). The aqueous medium has a boiling point of approximately 100° C.

The shell layers may be formed on the surfaces of the toner cores in a liquid containing either or both of a basic substance (specific examples include ammonia and sodium hydroxide) and a ring-opening agent (specific examples include acetic acid). In a situation in which an oxazoline group-containing shell material is used, an amount of non-ring-opened oxazoline groups in the shell layers can be adjusted by changing an amount of the basic substance and an amount of the ring-opening agent. The amount of non-ring-opened oxazoline groups tends to increase with an increase in the amount of the basic substance in the liquid. It is thought that a ring-opening reaction of oxazoline groups (a nucleophilic addition reaction to carbonyl groups) is inhibited as a result of a carboxylic acid being neutralized (trapped) by the basic substance. By contrast, the ring-opening agent accelerates the ring-opening reaction of oxazoline groups. Accordingly, the amount of non-ring-opened oxazoline groups tends to decrease with an increase in the amount of the ring-opening agent in the liquid.

The following describes the toner cores (a binder resin and internal additives), the shell layers, and the external additive in order. Non-essential components may be omitted in accordance with the intended use of the toner.

[Toner Core]

(Binder Resin)

Typically, the binder resin is a main component of the toner. In a preferable example of a magnetic toner containing a magnetic powder, the binder resin accounts for approximately 60% by mass of the toner cores. In a preferable example of a non-magnetic toner containing no magnetic powder, the binder resin accounts for approximately 85% by mass of the toner cores. Accordingly, properties of the binder resin are thought to have a great influence on overall properties of the toner cores. Properties (specific examples include hydroxyl value, acid value, Tg, and Tm) of the binder resin can be adjusted by using different resins in combination for the binder resin. The toner cores have a higher tendency to be anionic in a situation in which the binder resin is substituted with an ester group, a hydroxyl group, an ether group, an acid group, or a methyl group, and have a higher tendency to be cationic in a situation in which the binder resin is substituted with an amino group.

The toner cores of the toner having the above-described basic features contain a foamable polymer. The toner cores may further contain a non-foamable polymer. Particularly preferably, the foamable polymer is a styrene-acrylic acid-based resin. Particularly preferably, the non-foamable polymer is a polyester resin.

The styrene-acrylic acid-based resin is a copolymer of at least one styrene-based monomer and at least one acrylic acid-based monomer. In order to synthesize the styrene-acrylic acid-based resin, for example, styrene-based monomers and acrylic acid-based monomers shown below can be preferably used.

Examples of preferable styrene-based monomers include styrene, alkylstyrenes (specific examples include α-methylstyrene, m-methylstyrene, p-methylstyrene, p-ethylstyrene, and 4-tert-butylstyrene), hydroxystyrenes (specific examples include p-hydroxystyrene and m-hydroxystyrene), and halogenated styrenes (specific examples include α-chlorostyrene, o-chlorostyrene, m-chlorostyrene, and p-chlorostyrene).

Examples of preferable acrylic acid-based monomers include (meth)acrylic acid, (meth)acrylonitrile, alkyl (meth) acrylates, and hydroxyalkyl (meth)acrylates. Examples of preferable alkyl (meth)acrylates include methyl (meth)acrylate, ethyl (meth)acrylate, n-propyl (meth)acrylate, iso-propyl (meth)acrylate, n-butyl (meth)acrylate, iso-butyl (meth) acrylate, and 2-ethylhexyl (meth)acrylate. Examples of preferable hydroxyalkyl (meth)acrylates include 2-hydroxyethyl (meth)acrylate, 3-hydroxypropyl (meth)acrylate, 2-hydroxypropyl (meth)acrylate, and 4-hydroxybutyl (meth) acrylate.

A polyester resin can be synthesized through polycondensation of at least one polyhydric alcohol (specific examples include aliphatic diols, bisphenols, and tri- or higher-hydric alcohols shown below) with at least one polycarboxylic acid (specific examples include di-, tri-, and higher-basic carboxylic acids shown below).

Examples of preferable aliphatic diols include diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol), 2-butene-1,4-diol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include aromatic dicarboxylic acids (specific examples include phthalic acid, terephthalic acid, and isophthalic acid), α,ω-alkane dicarboxylic acids (specific examples include malonic acid, succinic acid, adipic acid, suberic acid, azelaic acid, sebacic acid, and 1,10-decanedicarboxylic acid), unsaturated dicarboxylic acids (specific examples include maleic acid, fumaric acid, citraconic acid, itaconic acid, and glutaconic acid), and cycloalkanedicarboxylic acids (specific examples include cyclohexanedicarboxylic acid).

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

(Colorant)

The toner cores may contain a colorant. A known pigment or dye matching a color of the toner can be used as a colorant. In order to obtain a toner suitable for image formation, the amount of the colorant is preferably at least 1 part by mass and no greater than 30 parts by mass relative to 100 parts by mass of the binder resin.

The toner cores may contain a black colorant. Carbon black can for example be used as a black colorant. Alternatively, a colorant that is adjusted to a black color using a yellow colorant, a magenta colorant, and a cyan colorant can be used as a black colorant.

The toner cores may contain a non-black colorant such as a yellow colorant, a magenta colorant, or a cyan colorant.

The yellow colorant that can be used is for example at least one compound selected from the group consisting of condensed azo compounds, isoindolinone compounds, anthraquinone compounds, azo metal complexes, methine compounds, and arylamide compounds. Examples of yellow colorants that can be preferably used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

The magenta colorant that can be used is for example at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Examples of magenta colorants that can be preferably used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

The cyan colorant that can be used is for example at least one compound selected from the group consisting of copper phthalocyanine compounds, anthraquinone compounds, and basic dye lake compounds. Examples of cyan colorants that can be preferably used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The toner cores may contain a releasing agent. The releasing agent is for example used in order to improve fixability or offset resistance of the toner. In order to improve fixability or offset resistance of the toner, the amount of the releasing agent is preferably at least 0.1 parts by mass and no greater than 30 parts by mass relative to 100 parts by mass of the binder resin.

Examples of releasing agents that can be preferably used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozocerite, ceresin, and petrolatum; waxes having a fatty acid ester as a main component such as montanic acid ester wax and castor wax; and waxes in which a part or all of a fatty acid ester has been deoxidized such as deoxidized carnauba wax. One releasing agent may be used independently, or two or more releasing agents may be used in combination.

(Charge Control Agent)

The toner cores may contain a charge control agent. The charge control agent is for example used in order to improve charge stability or a charge rise characteristic of the toner. The charge rise characteristic of the toner is an indicator as to whether the toner can be charged to a specific charge level in a short period of time.

The anionic strength of the toner cores can be increased through the toner cores containing a negatively chargeable charge control agent (specific examples include organic metal complexes and chelate compounds). The cationic strength of the toner cores can be increased through the toner cores containing a positively chargeable charge control agent (specific examples include pyridine, nigrosine, and quaternary ammonium salts). However, when it is ensured that the toner has sufficient chargeability, the toner cores do not need to contain a charge control agent.

(Magnetic Powder)

The toner cores may contain a magnetic powder. Examples of materials of the magnetic powder that can be preferably used include ferromagnetic metals (specific examples include iron, cobalt, nickel, and alloys of any one or more of the aforementioned metals), ferromagnetic metal oxides (specific examples include ferrite, magnetite, and chromium dioxide), and materials subjected to ferromagnetization (specific examples include carbon materials made ferromagnetic through thermal treatment). One magnetic powder may be used independently, or two or more magnetic powders may be used in combination. In order to inhibit elution of metal ions (for example, iron ions) from the magnetic powder, surface treatment is preferably performed on the magnetic powder.

[Shell Layer]

Examples of resins that can be preferably used to form the shell layers include aminoaldehyde resins, polyimide resins (specific examples include maleimide polymers and bismaleimide polymers), xylene-based resins, and vinyl resins (specific examples include a copolymer of at least two vinyl compounds). An aminoaldehyde resin is obtained through polycondensation of an amino group-substituted compound and an aldehyde (for example, formaldehyde). Examples of aminoaldehyde resins that can be used include melamine-based resins, urea-based resins, sulfonamide-based resins, glyoxal-based resins, guanamine-based resins, and aniline-based resins.

A vinyl resin that is particularly suitable as a material of the shell layers is a copolymer of at least two vinyl compounds including at least the compound represented by formula (3). In order to form such vinyl resin-containing shell layers, for example, an aqueous solution of an oxazoline group-containing polymer ("EPOCROS (registered Japanese trademark) WS series", product of Nippon Shokubai Co., Ltd.) can be used. "EPOCROS WS-300" contains a polymer of monomers (resin raw materials) including 2-vinyl-2-oxazoline and at least one alkyl (meth) acrylate. "EPOCROS WS-700" contains a polymer of monomers (resin raw materials) including 2-vinyl-2-oxazoline and at least one alkyl (meth)acrylate.

In order to achieve both heat-resistant preservability and low-temperature fixability of the toner, the shell layers preferably have a thickness of at least 0.1 nm and no greater than 10 nm. The thickness of the shell layers can be measured by analyzing a cross-sectional transmission electron microscope (TEM) image of the toner particles using commercially available image analysis software (for example, "WinROOF", product of Mitani Corporation). In a situation in which the thickness of the shell layer is not uniform for a single toner particle, the thickness of the shell layer is measured at each of four locations that are evenly spaced and the arithmetic mean of the four measured values is determined to be an evaluation value (a thickness of the shell layer) for the toner particle. More specifically, the four measurement locations are determined by drawing two straight lines that intersect at right angles at approximately the center of the cross-section of the toner particle and by determining four locations at which the two straight lines and the shell layer intersect to be the measurement locations. A boundary between a toner core and a shell layer can be determined for example by selectively dyeing the shell layer only. In a situation in which a boundary between a toner core and a shell layer in a TEM image is not clear, the boundary can be made clear through mapping of an element that is characteristic of the shell layer in the TEM image using a combination of TEM and electron energy loss spectroscopy (EELS).

[External Additive]

An external additive (specifically, a plurality of external additive particles) may be caused to adhere to surfaces of the toner mother particles. Unlike internal additives, the external additive is not to be present inside of the toner mother particles but to be selectively present only on the surfaces of the toner mother particles (surface portions of the toner particles). For example, the external additive particles can be caused to adhere to the surfaces of the toner mother particles by stirring the toner mother particles and the external additive together. The toner mother particles and the external additive particles do not chemically react with one another and are physically, not chemically, connected to one another. Strength of the connection between the toner mother particles and the external additive particles can be adjusted depending on stirring conditions (specific examples include stirring time and rotational speed for stirring), the particle diameter of the external additive particles, the shape of the external additive particles, and a surface condition of the external additive particles.

Preferably, the external additive is silica particles. The silica particles are readily chargeable by friction and are excellent in charge retention. The silica particles adhering to the surfaces of the toner mother particles impart fluidity and chargeability to the toner. Particularly preferably, the silica particles have a number average primary particle diameter of at least 10 nm and no greater than 30 nm in order to improve fluidity of the toner.

The external additive particles are not limited to the silica particles. The external additive particles may include non-silica external additive particles (external additive particles that are not silica particles) instead of or in addition to the silica particles. Examples of preferable non-silica external additive particles include particles of a metal oxide (specific examples include alumina, titanium oxide, magnesium oxide, zinc oxide, strontium titanate, and barium titanate). Particles of an organic acid compound such as a fatty acid metal salt (specific examples include zinc stearate) or resin particles may also be used as the external additive particles. Alternatively or additionally, composite particles, which are particles of a composite of a plurality of materials, may be used as the external additive particles.

The external additive particles may be surface-treated. For example, either or both of hydrophobicity and positive chargeability may be imparted to surfaces of the external additive particles using a surface treatment agent. Examples of surface treatment agents that can be preferably used include coupling agents (specific examples include silane coupling agents, titanate coupling agents, and aluminate coupling agents), silazane compounds (specific examples include chain silazane compounds and cyclic silazane compounds), and silicone oils (specific examples include dimethylsilicone oil). Particularly preferably, the surface treatment agent is a silane coupling agent or a silazane compound. Examples of preferable silane coupling agents include silane compounds (specific examples include methyltrimethoxysilane and aminosilane). Examples of preferable silazane compounds include hexamethyldisilazane (HMDS).

In order to allow the external additive to sufficiently exhibit its function while preventing detachment of the external additive particles from the toner particles, the amount of the external additive (in a situation in which plural types of external additive particles are used, a total amount of the external additive particles) is preferably at least 0.5 parts by mass and no greater than 10 parts by mass relative to 100 parts by mass of the toner mother particles.

Examples

The following describes Examples of the present disclosure. Table 1 shows toners (electrostatic latent image developing toners) TA-1 to TA-9 and TB-1 to TB-12 according to Examples and Comparative Examples. Table 2 shows toner cores CA-1 to CA-7, CB-1 to CB-6, CC-1 to CC-4, CD, CE, and CF that were used in production of the toners shown in Table 1. Table 3 shows resins RA-1 to RA-7 and RB-1 to RB-6 that were used in preparation of the toner cores shown in Table 2.

TABLE 1

| | | | | Foaming amount [mL] | |
|---|---|---|---|---|---|
| Toner | Core | Shell layer | IPA | $F_1$ | $F_2$ |
| TA-1 | CB-1 | Present | Present | 1200 | 1100 |
| TA-2 | CB-2 | Present | Present | 680 | 620 |
| TA-3 | CB-3 | Present | Present | 350 | 320 |
| TA-4 | CB-4 | Present | Present | 70 | 60 |
| TA-5 | CB-5 | Present | Present | 35 | 30 |
| TA-6 | CB-6 | Present | Present | 7 | 6 |
| TA-7 | CC-1 | Present | Absent | 120 | 110 |
| TA-8 | CC-2 | Present | Absent | 35 | 30 |
| TA-9 | CC-3 | Present | Absent | 7 | 6 |
| TB-1 | CA-1 | Present | Present | 0 | 0 |
| TB-2 | CA-2 | Present | Present | 0 | 0 |
| TB-3 | CA-3 | Present | Present | 0 | 0 |
| TB-4 | CA-4 | Present | Present | 0 | 0 |
| TB-5 | CA-5 | Present | Present | 0 | 0 |
| TB-6 | CA-6 | Present | Present | 0 | 0 |
| TB-7 | CA-7 | Absent | — | 0 | 0 |
| TB-8 | CC-3 | Absent | — | 0 | 0 |
| TB-9 | CC-4 | Absent | — | 0 | 0 |
| TB-10 | CD | Present | Present | 600 | 290 |
| TB-11 | CE | Present | Present | 300 | 150 |
| TB-12 | CF | Present | Present | 15 | 7 |

"IPA" in Table 1 means benzene-1,3-dicarboxylic acid (product of Tokyo Chemical Industry Co., Ltd.).

TABLE 2

| | SAc resin | | PES resin | OBSH | |
|---|---|---|---|---|---|
| Core | Type | Amount [parts by mass] | Amount [parts by mass] | Amount [parts by mass] | Tg [° C.] |
| CA-1 | RA-1 | 100 | 0.00 | 0.00 | 43 |
| CA-2 | RA-2 | 100 | 0.00 | 0.00 | 41 |
| CA-3 | RA-3 | 100 | 0.00 | 0.00 | 40 |
| CA-4 | RA-4 | 100 | 0.00 | 0.00 | 42 |
| CA-5 | RA-5 | 100 | 0.00 | 0.00 | 41 |
| CA-6 | RA-6 | 100 | 0.00 | 0.00 | 41 |
| CA-7 | RA-7 | 100 | 0.00 | 0.00 | 40 |
| CB-1 | RB-1 | 100 | 0.00 | 0.00 | — |
| CB-2 | RB-2 | 100 | 0.00 | 0.00 | — |
| CB-3 | RB-3 | 100 | 0.00 | 0.00 | — |
| CB-4 | RB-4 | 100 | 0.00 | 0.00 | — |
| CB-5 | RB-5 | 100 | 0.00 | 0.00 | — |
| CB-6 | RB-6 | 100 | 0.00 | 0.00 | — |
| CC-1 | RB-3 | 9.09 | 90.91 | 0.00 | — |
| CC-2 | RB-3 | 4.76 | 95.24 | 0.00 | — |
| CC-3 | RB-3 | 2.22 | 97.78 | 0.00 | — |
| CC-4 | RB-3 | 0.99 | 99.01 | 0.00 | — |
| CD | RA-1 | 100 | 0.00 | 5.50 | — |
| CE | RA-1 | 100 | 0.00 | 3.00 | — |
| CF | RA-1 | 100 | 0.00 | 0.15 | — |

Columns under the heading "SAc resin" in Table 2 show the type and the amount of styrene-acrylic acid-based resins used in the preparation of the toner cores. A column under the heading "PES resin" in Table 2 shows the amount of polyester resins used in the preparation of the toner cores. Specifically, the amount shown under the heading "PES resin" in Table 2 is equivalent to a total amount of a low viscosity polyester resin, a medium viscosity polyester resin, and a high viscosity polyester resin described below.

"OBSH" in Table 2 means an organic foaming agent ("CELLMIC (registered Japanese trademark) S", product of Sankyo Kasei Co., Ltd., ingredient: p,p'-oxybis benzene sulfonyl hydrazide).

TABLE 3

| Resin | Material | | | |
|---|---|---|---|---|
| | MMA [kg] | BA [kg] | CMS [kg] | TBAA |
| RA-1 | 4.9 | 1.7 | 1.400 | Absent |
| RA-2 | 5.4 | 1.9 | 0.700 | Absent |
| RA-3 | 5.6 | 2.0 | 0.350 | Absent |
| RA-4 | 6.0 | 1.9 | 0.070 | Absent |
| RA-5 | 6.0 | 2.0 | 0.040 | Absent |
| RA-6 | 6.0 | 2.0 | 0.007 | Absent |
| RA-7 | 4.9 | 1.7 | 1.400 | Absent |
| RB-1 | 4.9 | 1.7 | 1.400 | Present |
| RB-2 | 5.4 | 1.9 | 0.700 | Present |
| RB-3 | 5.6 | 2.0 | 0.350 | Present |
| RB-4 | 6.0 | 1.9 | 0.070 | Present |
| RB-5 | 6.0 | 2.0 | 0.035 | Present |
| RB-6 | 6.0 | 2.0 | 0.007 | Present |

Regarding the resin materials shown in Table 3, "MMA", "BA", "CMS", and "TBAA" mean as follows.

MMA: methyl methacrylate

BA: n-butyl acrylate

CMS: 4-chloromethyl styrene

TBAA: tetrabutylammonium azide

The following describes production methods, evaluation methods, and evaluation results of the toners TA-1 to TA-9 and TB-1 to TB-12 in order. In evaluations in which errors might occur, an evaluation value was calculated by obtaining an appropriate number of measured values and calculating the arithmetic mean of the measured values in order to ensure that any errors were sufficiently small. The glass transition point (Tg) was measured according to a method described below, unless otherwise stated.

<Tg Measurement Method>

A heat absorption curve (vertical axis: heat flow (DSC signal), horizontal axis: temperature) of a sample (for example, a resin) was plotted using a differential scanning calorimeter ("DSC-6220", product of Seiko Instruments Inc.). Subsequently, the glass transition point (Tg) of the sample was read from the plotted heat absorption curve. On the plotted heat absorption curve, a temperature at a point of inflection (an intersection point between an extrapolation of a base line and an extrapolation of an inclined portion of the curve) caused due to glass transition corresponds to the glass transition point (Tg) of the sample.

[Material Preparation]

(Synthesis of Resins RA-1 to RA-7)

Materials (methyl methacrylate, n-butyl acrylate, and 4-chloromethyl styrene) in respective amounts shown in Table 3 and 5 mg of azobisisobutyronitrile (AIBN) were added into a four-necked flask equipped with a thermometer, a nitrogen inlet tube, a stirrer (a stainless steel stirring impeller), and a down flow condenser (a heat exchanger). For example, in the synthesis of the resin RA-1, 4.9 kg of methyl methacrylate (MMA), 1.7 kg of n-butyl acrylate (BA), and 1.4 kg of 4-chloromethyl styrene (CMS) were added (see Table 3).

Subsequently, a nitrogen atmosphere (inert atmosphere) was maintained in the flask with nitrogen gas introduced into the flask through the nitrogen inlet tube. Subsequently, the flask contents were heated up to 70° C. under stirring in the nitrogen atmosphere. The flask contents were then caused to undergo a reaction (a polycondensation reaction) under stirring at 70° C. in the nitrogen atmosphere. Once 1 hour elapsed after the initiation of the reaction, 1 mL of ethylene glycol dimethacrylate was added into the flask, and the flask contents were caused to react for 2 hours. Thereafter, methanol in a mass approximately five times the mass of the flask contents was added into the flask to precipitate a reaction product. Thus, each of polymers (the resins RA-1 to RA-7) was obtained within the flask. The thus obtained resins RA-1 to RA-7 each had a mass average molecular weight (Mw) of 150,000. The resins RA-1 to RA-7 were each a non-foamable polymer.

(Synthesis of Resins RB-1 to RB-6)

Resins each having a mass average molecular weight (Mw) of 150,000 were obtained in the same manner as in "Synthesis of Resins RA-1 to RA-7" above. With respect to each of the thus obtained resins, 300 g of the resin and 500 mL of tetrahydrofuran (THF) were added into a flask to dissolve the resin. Subsequently, 1.2 equivalents of tetrabutylammonium azide (TBAA) relative to the 4-chloromethyl styrene unit in the resin was added into the flask, and the flask contents were caused to react under stirring at room temperature (approximately 25° C.) for 12 hours. Thereafter, the flask contents were put in 10 L of ion exchanged water to cause a solid to deposit in the liquid. The solid was then separated from the liquid by filtration. The thus separated solid was subjected to reduced pressure drying at room temperature (approximately 25° C.) for 48 hours. Through the above, each of polymers (the resins RB-1 to RB-6) was obtained. The resins RB-1 to RB-6 were each a foamable polymer.

(Preparation of Toner Cores CA-1 to CA-7 and CB-1 to CB-6)

An FM mixer (product of Nippon Coke & Engineering Co., Ltd.) was used to mix 100 parts by mass of a styrene-acrylic acid-based resin of a type shown in Table 2, 5 parts by mass of a colorant (ingredient: a copper phthalocyanine pigment, color index: Pigment Blue 15:3), and 5 parts by mass of an ester wax ("NISSAN ELECTOL (registered Japanese trademark) WEP-9", product of NOF Corporation). For example, in the preparation of the toner cores CA-1, the resin RA-1 was used as the styrene-acrylic acid-based resin (see Table 2).

Subsequently, the resultant mixture was melt-kneaded using a twin-screw extruder ("PCM-30", product of Ikegai Corp.) at a cylinder temperature of 80° C. Subsequently, the resultant melt-kneaded product was cooled. After cooling, the melt-kneaded product was pulverized using a pulverizer ("Turbo Mill", product of FREUND-TURBO CORPORATION). Subsequently, the resultant pulverized product was classified using a classifier (an air classifier using the Coanda effect: "Elbow Jet Type EJ-LABO", product of Nittetsu Mining Co., Ltd.). Thus, toner cores having a volume median diameter ($D_{50}$) of 6 μm (each of the toner cores CA-1 to CA-7 and CB-1 to CB-6) were obtained.

(Preparation of Toner Cores CC-1 to CC-4)

An FM mixer (product of Nippon Coke & Engineering Co., Ltd.) was used to mix a styrene-acrylic acid-based resin (the resin RB-3) in an amount shown in Table 2, a polyester resin in an amount shown in Table 2, 5 parts by mass of a colorant (ingredient: a copper phthalocyanine pigment, color index: Pigment Blue 15:3), and 5 parts by mass of an ester wax ("NISSAN ELECTOL (registered Japanese trademark) WEP-9", product of NOF Corporation). A mixture of a low viscosity polyester resin (manufacturer: Kao Corporation, Tg: 38° C., Tm: 65° C.), a medium viscosity polyester resin (manufacturer: Kao Corporation, Tg: 53° C., Tm: 84° C.), and a high viscosity polyester resin (manufacturer: Kao Corporation, Tg: 71° C., Tm: 120° C.) mixed at a mass ratio of 11:9:2 (low viscosity polyester resin:medium viscosity polyester resin:high viscosity polyester resin) was used as the polyester resin. For example, in the preparation of the toner cores CC-1, 9.09 parts by mass of the styrene-acrylic acid-based resin (the resin RB-3) and 90.91 parts by mass of the polyester resin (specifically, the mixture of the low viscosity polyester resin, the medium viscosity polyester resin, and the high viscosity polyester resin) were mixed (see Table 2).

Subsequently, melt-kneading, pulverization, and classification were performed in the same manner as in "Preparation of Toner Cores CA-1 to CA-7 and CB-1 to CB-6" above. Thus, toner cores having a volume median diameter ($D_{50}$) of 6 μm (each of the toner cores CC-1 to CC-4) were obtained.

(Preparation of Toner Cores CD, CE, and CF)

An FM mixer (product of Nippon Coke & Engineering Co., Ltd.) was used to mix 100 parts by mass of a styrene-acrylic acid-based resin (the resin RA-1), an organic foaming agent (CELLMIC S) in an amount shown under the heading "OBSH" in Table 2, 5 parts by mass of a colorant (ingredient: a copper phthalocyanine pigment, color index: Pigment Blue 15:3), and 5 parts by mass of an ester wax ("NISSAN ELECTOL (registered Japanese trademark) WEP-9", product of NOF Corporation). For example, in the preparation of the toner cores CD, 5.5 parts by mass of the organic foaming agent (CELLMIC S) was mixed (see Table 2) relative to 100 parts by mass of the styrene-acrylic acid-based resin (the resin RA-1).

Subsequently, melt-kneading, pulverization, and classification were performed in the same manner as in "Preparation of Toner Cores CA-1 to CA-7 and CB-1 to CB-6" above. Thus, toner cores having a volume median diameter ($D_{50}$) of 6 μm (each of the toner cores CD, CE, and CF) were obtained.

The glass transition point (Tg) of the toner cores CA-1 to CA-7 obtained as described above was measured. The measurement results are shown in Table 2. For example, the toner cores CA-1 had a Tg of 43° C. The Tg was measured by the above-described differential scanning calorimetry. Note that the glass transition point (Tg) of the toner cores CB-1 to CB-6, CC-1 to CC-4, CD, CE, and CF was not measured because these toner cores foam through heating.

[Toner Production Method]

Each of the toners TA-1 to TA-9 and TB-1 to TB-12 was produced through the following processes using the toner cores (specified one of the toner cores CA-1 to CA-7, CB-1 to CB-6, CC-1 to CC-4, CD, CE, and CF) shown in Table 1. However, the production of the toners TB-7 to TB-9 did not involve a shell layer formation process, a washing process, and a drying process described below, and used the toner cores CA-7, CC-3, and CC-4 as the toner mother particles.

(Shell Layer Formation Process)

A three-necked flask having a capacity of 1 L and equipped with a thermometer and a stirring impeller was set up in a water bath, and 300 mL of ion exchanged water was added into the flask. Thereafter, the internal temperature of the flask was kept at 30° C. using the water bath. Subsequently, 50 g of an aqueous solution of an oxazoline group-containing polymer ("EPOCROS (registered Japanese trademark) WS-300", product of Nippon Shokubai Co., Ltd., mass ratio of monomers: methyl methacrylate/2-vinyl-2-oxazoline=1/9, solids concentration: 10% by mass) was added into the flask. In the production of each of the toners TA-1 to TA-6, TB-1 to TB-6, and TB-10 to TB-12, as shown in Table 1, 1 g of benzene-1,3-dicarboxylic acid (isophthalic acid) was further added into the flask.

Subsequently, the flask contents were sufficiently stirred. Subsequently, 300 g of the toner cores (specified one of the toner cores CA-1 to CA-6, CB-1 to CB-6, CC-1 to CC-3, CD, CE, and CF shown in Table 1) were added into the flask, and the flask contents were stirred at a rotational speed of 200 rpm for 1 hour. Thereafter, 300 mL of ion exchanged water was added into the flask.

Subsequently, 6 mL of a 1% by mass aqueous ammonia solution was added into the flask. Subsequently, the internal temperature of the flask was increased up to 60° C. at a rate of 0.5° C./minute while the flask contents were stirred at a rotational speed of 150 rpm.

After the internal temperature of the flask reached 60° C., the internal temperature of the flask was kept at 60° C. for 1 hour while the flask contents were stirred at a rotational speed of 100 rpm.

Once the internal temperature of the flask had been kept at 60° C. for 1 hour, 10 mL of a 1% by mass aqueous acetic acid solution was added into the flask, and the internal temperature of the flask was kept at 60° C. for 30 minutes while the flask contents were stirred at a rotational speed of 100 rpm.

Subsequently, the flask contents were adjusted to pH 7 through addition of a 1% by mass aqueous ammonia solution into the flask. Subsequently, the flask contents were cooled to room temperature (approximately 25° C.) to give a dispersion containing toner mother particles. The toner mother particles had shell layers each entirely covering a surface of the corresponding toner core.

(Washing Process)

The toner mother particle-containing dispersion obtained as described above was filtered using a Buchner funnel (solid-liquid separation) to collect a wet cake of the toner mother particles. Thereafter, the resultant wet cake of the toner mother particles was dispersed in ion exchanged water. Furthermore, dispersion and filtering were repeated five times to wash the toner mother particles.

(Drying Process)

Subsequently, the resultant toner mother particles were dried using a continuous type surface modifier ("COATMIZER" (registered Japanese trademark)", product of Freund Corporation) under conditions of a hot air flow temperature of 45° C. and a blower flow rate of 2 $m^3$/minute. As a result, the dried toner mother particles were obtained.

(External Additive Addition Process)

Subsequently, an external additive was added to the resultant toner mother particles. Specifically, 100 parts by mass of the toner mother particles and 1 part by mass of positively chargeable silica particles ("AEROSIL (registered Japanese trademark) REA90", product of Nippon Aerosil Co., Ltd., content: dry silica particles to which positive chargeability was imparted through surface treatment, number average primary particle diameter: 20 nm) were mixed for 5 minutes using an FM mixer (product of Nippon Coke & Engineering Co., Ltd.) having a capacity of 10 L to cause the external additive (the silica particles) to adhere to the surfaces of the toner mother particles. Subsequently, the resultant particles were sifted using a 200-mesh sieve (pore size: 75 μm). As a result, each of the toners (the toners TA-1 to TA-9 and TB-1 to TB-12) including a number of toner particles was obtained.

With respect to each of the toners TA-1 to TA-9 and TB-1 to TB-12, the foaming amount $F_1$ (specifically, the foaming amount measured at the time X according to the above-described foaming amount measurement method and determined relative to 100 g of the toner) and the foaming amount $F_2$ (specifically, the foaming amount measured at the time Y according to the above-described foaming amount measurement method and determined relative to 100 g of the toner) were measured. The measurement results are shown in Table 1. For example, the toner TA-1 had a foaming amount $F_1$ of 1,200 mL and a foaming amount $F_2$ of 1,100 mL. The foaming amount $F_1$ and the foaming amount $F_2$ were measured according to the method described below.

<Foaming Amount Measurement Method>

With respect to each of the toners TA-1 to TA-9 and TB-1 to TB-12, 100 g of the toner (measurement target) and 100 mL of silicone oil ("KF-96", product of Shin-Etsu Chemical Co., Ltd.) were added into a separable flask having a capacity of 300 mL and equipped with a thermometer and a stirrer (a stirring impeller). Subsequently, the flask was set up in an oil bath at 30° C. Next, a device for collecting gas generated in the liquid in the flask over water (also referred to below as a "gas collection device") was attached to the flask. The gas collection device was equipped with a collection container for collecting gas generated by the flask contents. The oil bath was controlled so that the collection container and the flask were at the same temperature. Subsequently, the flask contents were heated up to 120° C. at a rate of 1° C./minute using the oil bath under stirring at a rotational speed of 100 rpm (stirring impeller). After completion of the heating, the flask contents were kept at 120° C. for 30 minutes under stirring at a rotational speed of 100 rpm (stirring impeller). The amount of gas in the collection container was measured once 30 minutes elapsed after the temperature of the flask contents had reached 120° C. (that is, at the time X). The amount of gas in the collection container was equivalent to the amount of gas collected over water during a period from when the heating was started at 30° C. to when 30 minutes elapsed after the temperature of the flask contents had reached 120° C. The amount of gas measured at this time was equivalent to the foaming amount $F_1$.

Subsequently, the flask and the collection container were cooled to 0° C. at a rate of 1° C./minute using the oil bath. Once the temperature of the flask contents reached 0° C. (that is, at the time Y), the amount of gas in the collection container was measured. The amount of gas in the collection container was equivalent to the amount of gas collected over water during a period from when the heating was started at 30° C. to when the temperature of the flask contents reached 0° C. through the cooling after the temperature of the flask contents had been kept at 120° C. for 30 minutes. The amount of gas measured at this time was equivalent to the foaming amount $F_2$.

[Evaluation Method]

Each of the samples (the toners TA-1 to TA-9 and TB-1 to TB-12) was evaluated according to methods described below.

(Heat-Resistant Preservability)

With respect to each of the toners TA-1 to TA-9 and TB-1 to TB-12, 3 g of the toner (evaluation target) was loaded into a polyethylene container having a capacity of 20 mL, and the container was left to stand in a thermostatic chamber set at a specific temperature (55° C. or 58° C.) for 3 hours. Subsequently, the container in the thermostatic chamber was cooled to 20° C., and then was taken out of the thermostatic chamber. Through the above, an evaluation toner was obtained.

Subsequently, the evaluation toner was placed on a sieve having a known mass and a pore size of 106 μm. The mass of the toner on the sieve (mass of toner before sifting) was calculated by measuring the total mass of the sieve and the evaluation toner thereon. Subsequently, the sieve was set in a powder property evaluation machine ("POWDER TESTER (registered Japanese trademark)", product of Hosokawa Micron Corporation) and shaken for 30 seconds at a rheostat level of 5 in accordance with a manual of the powder property evaluation machine (POWDER TESTER). After the sifting, the mass of toner remaining on the sieve (mass of toner after sifting) was calculated by measuring the total mass of the sieve and the toner thereon. A toner aggregation rate (unit: % by mass) was calculated in accordance with the following equation based on the mass of the toner before sifting and the mass of the toner after sifting.

$$\text{Aggregation rate} = 100 \times \text{mass of toner after sifting} / \text{mass of toner before sifting}$$

The aggregation rate was calculated for both the case where the temperature of the thermostatic chamber was set to 55° C. and the case where the temperature of the thermostatic chamber was set to 58° C. Heat-resistant preservability was evaluated in accordance with the following standard.

Good: The aggregation rate was not greater than 20% by mass in both the experiment carried out at 55° C. and the experiment carried out at 58° C.

Poor: The aggregation rate was greater than 20% by mass in one of the experiment carried out at 55° C. and the experiment carried out at 58° C.

(Low-Temperature Fixability)

Low-temperature fixability of each of the toners TA-1 to TA-9, TB-1 to TB-6, and TB-10 to TB-12 having the shell layers was evaluated. Specifically, a minimum fixable temperature of the evaluation target toner was measured and compared with a minimum fixable temperature of the evaluation target toner in which the shell layers had been omitted (also referred to below as a "toner having no shell layers") to evaluate low-temperature fixability of the evaluation target toner. The toner having no shell layers was obtained by performing the external additive addition process on the toner cores without performing the shell layer formation process, the washing process, and the drying process. For example, the toner TA-1 in which the shell layers had been omitted (the toner having no shell layers) was obtained by performing the external additive addition process described above on the toner cores CB-1 (see Table 1). The following describes a method for measuring the minimum fixable temperature of the evaluation target toner.

(Preparation of Evaluation Developer)

With respect to each of the toners TA-1 to TA-9, TB-1 to TB-6, and TB-10 to TB-12, the toner (evaluation target) and a developer carrier (a carrier for "TASKalfa5550ci", product of KYOCERA Document Solutions Inc.) were mixed using a ball mill for 30 minutes under environmental conditions of a temperature of 25° C. and a relative humidity of 50% to prepare an evaluation developer (two-component developer). The toner accounted for 12% by mass of the evaluation developer.

A printer (an evaluation apparatus obtained by modifying "FS-C5250DN", product of KYOCERA Document Solutions Inc., to enable adjustment of fixing temperature) having a roller-roller type heat-pressure fixing device (nip width: 8 mm) was used as an evaluation apparatus. The evaluation developer prepared as described above was loaded into a developing device of the evaluation apparatus, and a toner for replenishment use (the evaluation target among the toners TA-1 to TA-9, TB-1 to TB-6, and TB-10 to TB-12) was loaded into a toner container of the evaluation apparatus.

The evaluation apparatus was used to form a solid image (specifically, an unfixed toner image) having a size of 25 mm×25 mm on paper (A4 size plain paper) having a basis weight of 90 g/m$^2$ at a linear velocity of 200 mm/second and a toner application amount of 1.0 mg/cm$^2$ under environmental conditions of a temperature of 25° C. and a relative humidity of 50%. Subsequently, the paper with the image (the unfixed toner image) formed thereon was passed through the fixing device of the evaluation apparatus.

The minimum fixable temperature was measured in a fixing temperature range of from 100° C. to 200° C. Specifically, the fixing temperature of the fixing device was gradually increased from 100° C. to determine the lowest temperature at which the solid image (the toner image) was fixable to the paper (minimum fixable temperature). Determination of whether or not the toner was fixable was carried out through a fold-rubbing test. Specifically, the evaluation paper passed through the fixing device was folded with a surface on which the image was formed facing inward and a 1-kg weight covered with cloth was rubbed back and forth on the fold five times. Subsequently, the paper was opened up and a fold portion (a portion on which the solid image was formed) of the paper was observed. Then, the length of toner peeling of the fold portion (peeling length) was measured. The minimum fixable temperature was determined to be the lowest temperature among fixing temperatures for which the peeling length was no greater than 1 mm.

The minimum fixable temperature of the toner having no shell layers was measured in the same manner as in the measurement of the minimum fixable temperature of the toner. Low-temperature fixability was evaluated as good if a difference between the minimum fixable temperature of the evaluation target toner (specifically, the toner having the shell layers) and the minimum fixable temperature of the evaluation target toner in which the shell layers had been omitted (specifically, the toner having no shell layers) was less than 10° C., and was evaluated as poor if the difference was greater than or equal to 10° C.

(UFP Yield)

Evaluation developers and an evaluation apparatus (an evaluation apparatus obtained by modifying "FS-C5250DN", product of KYOCERA Document Solutions Inc., to enable adjustment of fixing temperature) were prepared in the same manner as in the low-temperature fixability evaluation. With respect to each of the toners TA-1 to TA-9 and TB-1 to TB-12, the evaluation developer and the toner for replenishment use (evaluation target) were loaded into the evaluation apparatus in the same manner as in the low-temperature fixability evaluation.

The evaluation apparatus was placed in a stainless steel chamber (environmental chamber having a capacity of approximately 5 m$^3$), and the chamber was ventilated over 2 hours. Subsequently, the evaluation apparatus was used to perform a printing durability test over 10 minutes under conditions of a fixing temperature of 175° C. and a printing rate of 26 sheets/minute. The number of UFPs that were produced was determined in accordance with an award criterion of the German ecolabel, "The Blue Angel" (specifically, "RAL-UZ171" provided by the German Institute for Quality Assurance and Labeling (RAL)). The number of UFPs was determined using a particle size distribution meter ("Fast Mobility Particle Sizer (FMPS) 3091", product of TSI Incorporated, charging method: unipolar diffusion charging, time resolution: 1 second, sample flow rate: 10 L/minute).

Based on the determination, a number of UFPs of less than $1.0\times10^5$ was evaluated as good, and a number of UFPs of greater than or equal to $1.0\times10^5$ was evaluated as not good.

[Evaluation Result]

Table 4 shows the results of the heat-resistant preservability evaluation, the low-temperature fixability evaluation, and the UFP yield evaluation on the toners TA-1 to TA-9 and TB-1 to TB-12. A column under the heading "Low-temperature fixability" in Table 4 shows values each calculated by subtracting the minimum fixable temperature of the toner having no shell layers from the minimum fixable temperature of the evaluation target toner.

TABLE 4

| Toner | UFP yield | Heat-resistant preservability | Low-temperature fixability [° C.] |
|---|---|---|---|
| TA-1 | Good | Good | 0 |
| TA-2 | Good | Good | 0 |
| TA-3 | Good | Good | +2 |
| TA-4 | Good | Good | +2 |
| TA-5 | Good | Good | +6 |
| TA-6 | Good | Good | +6 |
| TA-7 | Good | Good | +2 |
| TA-8 | Good | Good | +4 |
| TA-9 | Good | Good | +6 |
| TB-1 | Good | Good | +12 (Poor) |
| TB-2 | Good | Good | +10 (Poor) |
| TB-3 | Good | Good | +10 (Poor) |
| TB-4 | Good | Good | +14 (Poor) |
| TB-5 | Good | Good | +10 (Poor) |
| TB-6 | Good | Poor | +12 (Poor) |
| TB-7 | Good | Poor | — |
| TB-8 | Good | Poor | — |
| TB-9 | Good | Poor | — |
| TB-10 | Not good | Good | +6 |
| TB-11 | Not good | Good | +6 |
| TB-12 | Not good | Good | +8 |

The toners TA-1 to TA-9 (the toners according to Examples 1 to 9) each had the above-described basic features. Specifically, each of the toners TA-1 to TA-9 included a plurality of toner particles each including a toner core and a shell layer covering a surface of the toner core. The toner cores contained a foamable polymer (specifically, specified one of the resins RB-1 to RB-6) having a foamable group (specifically, an azido group) that is foamable through heating (see Tables 1 to 3). Each of the shell layers entirely covered the surface of the corresponding toner core.

The ratio of the amount of the foamable polymer to the sum of the amount of the foamable polymer and the amount of the non-foamable polymer in each of the toners TA-1 to TA-9 was at least 0.02 and no greater than 1.00 (see Tables 1 and 2). For example, the ratio was 1.00 in each of the toners TA-1 to TA-6 (see Table 2). For another example, the ratio was 0.09 (=9.09/(9.09+90.91) in the toner TA-7 including the toner cores CC-1 (see Table 2). The value calculated by subtracting the foaming amount $F_2$ from the foaming amount $F_1$ was no greater than 25% by volume of the foaming amount $F_1$ in each of the toners TA-1 to TA-9. For example, in the toner TA-1, the foaming amount $F_1$ was 1,200 mL, the "$F_1$-$F_2$" was 100 mL (=1,200 mL−1,100 mL), and the "$F_1$-$F_2$" was 8.3% by volume (=100×100/1,200) of the foaming amount $F_1$.

As indicated in Table 4, each of the toners TA-1 to TA-9 had good heat-resistant preservability and good low-temperature fixability. Furthermore, each of the toners TA-1 to TA-9 produced fewer UFPs when used in continuous printing.

What is claimed is:

1. A toner comprising a plurality of toner particles each including a core and a shell layer covering a surface of the core, wherein the core contains a foamable polymer having a foamable group that is foamable through heating, and the shell layer entirely covers the surface of the core.

2. The toner according to claim 1, wherein the foamable group is an azido group, and the core generates nitrogen through an exothermic reaction of the azido group.

3. The toner according to claim 1, wherein the foamable polymer includes a unit represented by formula (1) shown below, (1)

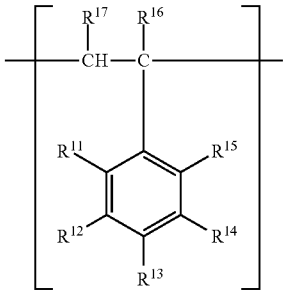

where in formula (1), $R^{16}$ and $R^{17}$ each represent, independently of one another, a hydrogen atom, a halogen atom, or an optionally substituted alkyl group, at least one of $R^{11}$, $R^{12}$, $R^{13}$, $R^{14}$, and $R^{15}$ represents an azidomethyl group, and the others each represent, independently of one another, a hydrogen atom, a halogen atom, a hydroxyl group, an optionally substituted alkyl group, an optionally substituted alkoxy group, or an optionally substituted aryl group.

4. The toner according to claim 3, wherein the foamable polymer further includes a unit represented by formula (2) shown below, (2)

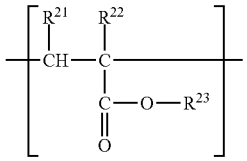

where in formula (2), $R^{21}$ and $R^{22}$ each represent, independently of one another, a hydrogen atom or a methyl group, and $R^{23}$ represents an optionally substituted alkyl group having a carbon number of at least 1 and no greater than 8.

5. The toner according to claim 1, wherein the core further contains a non-foamable polymer.

6. The toner according to claim 1, wherein the shell layer contains a thermosetting resin which is a copolymer of at least two vinyl compounds including at least a compound represented by formula (3) shown below, (3)

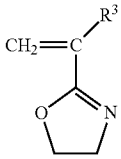

where in formula (3), $R^3$ represents a hydrogen atom or an optionally substituted alkyl group.

7. The toner according to claim 1, wherein the core has a glass transition point of at least 35° C. and no greater than 45° C.

* * * * *